US011578878B2

(12) United States Patent
D'Souza et al.

(10) Patent No.: US 11,578,878 B2
(45) Date of Patent: Feb. 14, 2023

(54) FILTER ASSEMBLY FOR AN AIR CONDITIONER UNIT

(71) Applicant: Haier US Appliance Solutions, Inc., Wilmington, DE (US)

(72) Inventors: Bryan Isaac D'Souza, Louisville, KY (US); Robert T. Mills, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 273 days.

(21) Appl. No.: 16/676,914

(22) Filed: Nov. 7, 2019

(65) Prior Publication Data

US 2021/0140652 A1 May 13, 2021

(51) Int. Cl.
*F24F 1/0073* (2019.01)
*F24F 1/031* (2019.01)
*F24F 1/027* (2019.01)

(52) U.S. Cl.
CPC ..... *F24F 1/0073* (2019.02); *F24F 1/027* (2013.01); *F24F 1/031* (2019.02)

(58) Field of Classification Search
CPC ..... F24F 1/0073; F24F 1/027; F24F 1/031; F24F 13/085; F24F 13/28; F24F 1/035; F24F 1/0328; F24F 1/022; B01D 46/001; B01D 2279/50; B01D 2265/024; Y10S 55/31
See application file for complete search history.

(56) References Cited

U.S. PATENT DOCUMENTS

| | | | | |
|---|---|---|---|---|
| 6,719,820 | B2 | 4/2004 | Wolf et al. | |
| 7,848,100 | B2 | 12/2010 | Wayman et al. | |
| 9,612,023 | B2 | 4/2017 | Salpietra | |
| 2003/0074872 | A1* | 4/2003 | Lawlor, Sr. | B01D 46/001 55/495 |
| 2013/0125520 | A1* | 5/2013 | Gorman | B01D 46/0002 55/509 |
| 2017/0276400 | A1 | 9/2017 | Hugues et al. | |
| 2020/0101408 | A1* | 4/2020 | Brown | F24F 1/0073 |
| 2020/0269173 | A1* | 8/2020 | Salunkhe | F24F 8/10 |
| 2020/0360858 | A1* | 11/2020 | Mathur | A61L 9/205 |

FOREIGN PATENT DOCUMENTS

CN 206369323 U * 8/2017

* cited by examiner

*Primary Examiner* — Frantz F Jules
*Assistant Examiner* — Martha Tadesse
(74) *Attorney, Agent, or Firm* — Dority & Manning, P.A.

(57) ABSTRACT

A symmetric pair of mounting brackets for mounting one of a plurality of air filters to a mounting plate of an air conditioner unit are provided. The mounting brackets each define a plurality of mounting surfaces with equidistantly space mounting holes. The mounting surfaces are spaced apart from a plurality of retention surfaces, with the distance between each respective mounting surface and retention surface varying to accommodate a different filter size such that the air conditioner may operate using different filter sizes by simply changing the installation orientation of the mounting brackets.

18 Claims, 11 Drawing Sheets

FILTER ASSEMBLY FOR AN AIR CONDITIONER UNIT

FIELD OF THE INVENTION

The present disclosure relates generally to air conditioner units, and more particularly to filter assemblies having universal mounting brackets for receiving filters having different sizes.

BACKGROUND OF THE INVENTION

Air conditioner or conditioning units are conventionally utilized to adjust the temperature indoors—i.e. within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed within the indoors that is connected, by e.g., tubing carrying the refrigerant, to another portion located outdoors. These types of units are typically used for conditioning the air in larger spaces. Another type of air conditioner unit, referred to as a packaged terminal air conditioner unit, operate like split heat pump systems, except that the indoor and outdoor portions are defined by a bulkhead and all system components are housed within a single package.

Notably, hotel owners (or users of air conditioner units in general) frequently require differing levels of air filtration depending on environmental factors and conditioned space needs. In order to increase the level of filtration while maintaining a certain system airflow, more filter media can be used (for example, in a pleated configuration), leading to a deeper/thicker filter size. Typical air conditioner systems only accommodate one depth/thickness of filter. Alternatively, certain air conditioner systems may permit the use of interchangeable filters, but often require complex and costly installation procedures for each filter.

Accordingly, improved air conditioner units having improved filter assemblies would be useful. More specifically, a filter assembly that is simple to install and accommodates different filter sizes would be particularly beneficial.

BRIEF DESCRIPTION OF THE INVENTION

Aspects and advantages of the invention will be set forth in part in the following description, or may be obvious from the description, or may be learned through practice of the invention.

In accordance with one exemplary embodiment of the present disclosure, a symmetric pair of mounting brackets for mounting one of a plurality of air filters to an air conditioner unit is provided. Each of the mounting brackets includes a first mounting surface and a first retention surface spaced apart by a first gap along a first direction, the first gap being substantially equivalent to a first thickness of a first filter of the plurality of air filters and a second mounting surface and a second retention surface spaced apart by a second gap along a second direction, the second gap being substantially equivalent to a second thickness of a second filter of the plurality of air filters.

In accordance with another exemplary embodiment of the present disclosure, a method of mounting a filter on a mounting plate of an air conditioner unit using symmetric mounting brackets is provided. The method includes determining a filter size, determining a mounting orientation of the mounting brackets based on the filter size, attaching the mounting brackets to the mounting plate using mounting surfaces that correspond to the mounting orientation, and installing the filter into the filter slot.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
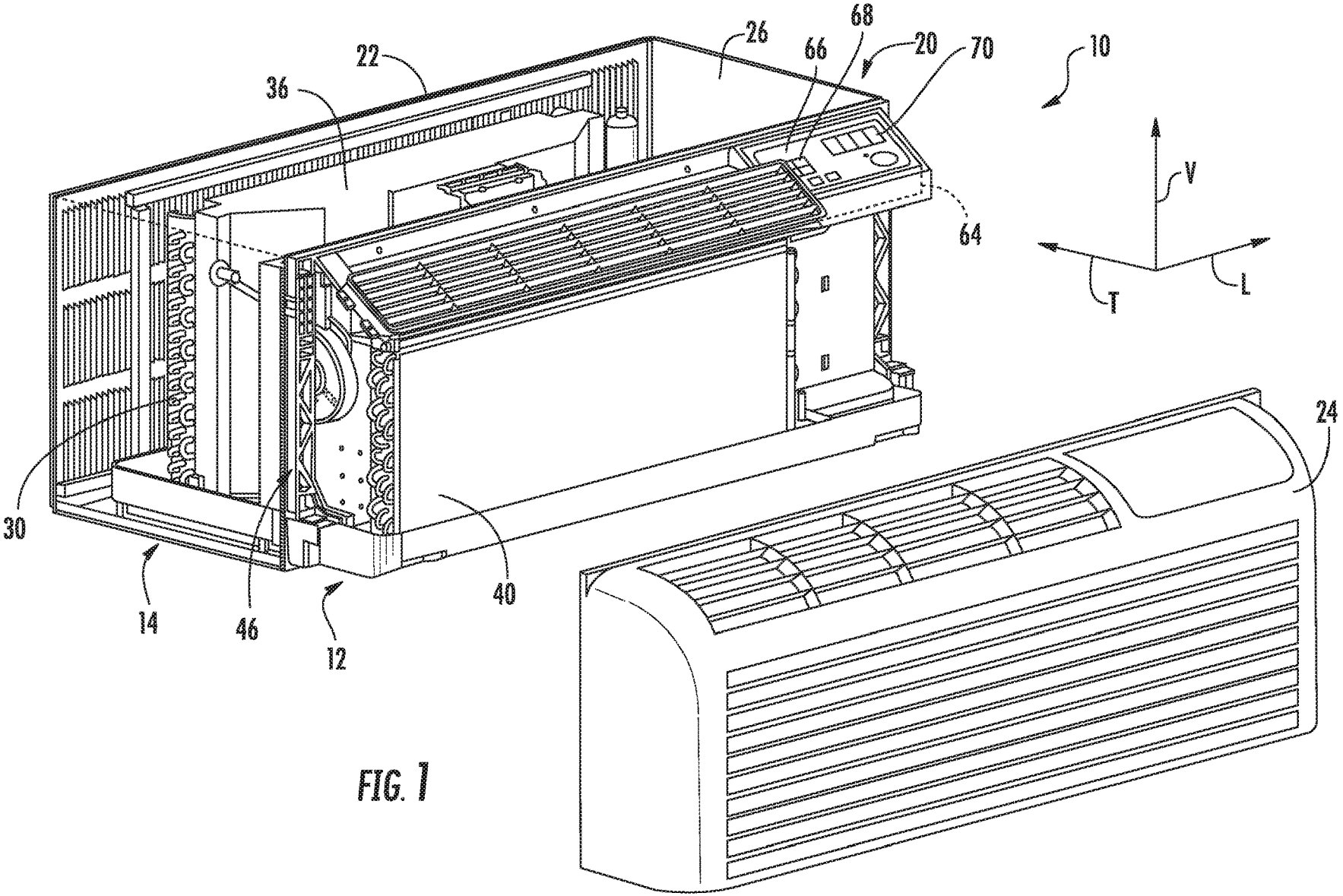
FIG. 1 provides a perspective view of an air conditioner unit, with part of an indoor portion exploded from a remainder of the air conditioner unit for illustrative purposes, in accordance with one exemplary embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows and "downstream" refers to the direction to which the fluid flows. In addition, terms of approximation, such as "approximately," "substantially," or "about," refer to being within a ten percent margin of error.

Referring now to FIG. 1, an air conditioner unit 10 is provided. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, an outdoor fan 32 (FIG. 2), and a compressor 34 (FIG. 2) may be housed within the wall sleeve 26. A casing 36 may additionally enclose outdoor fan 32, as shown.

Figure 2:
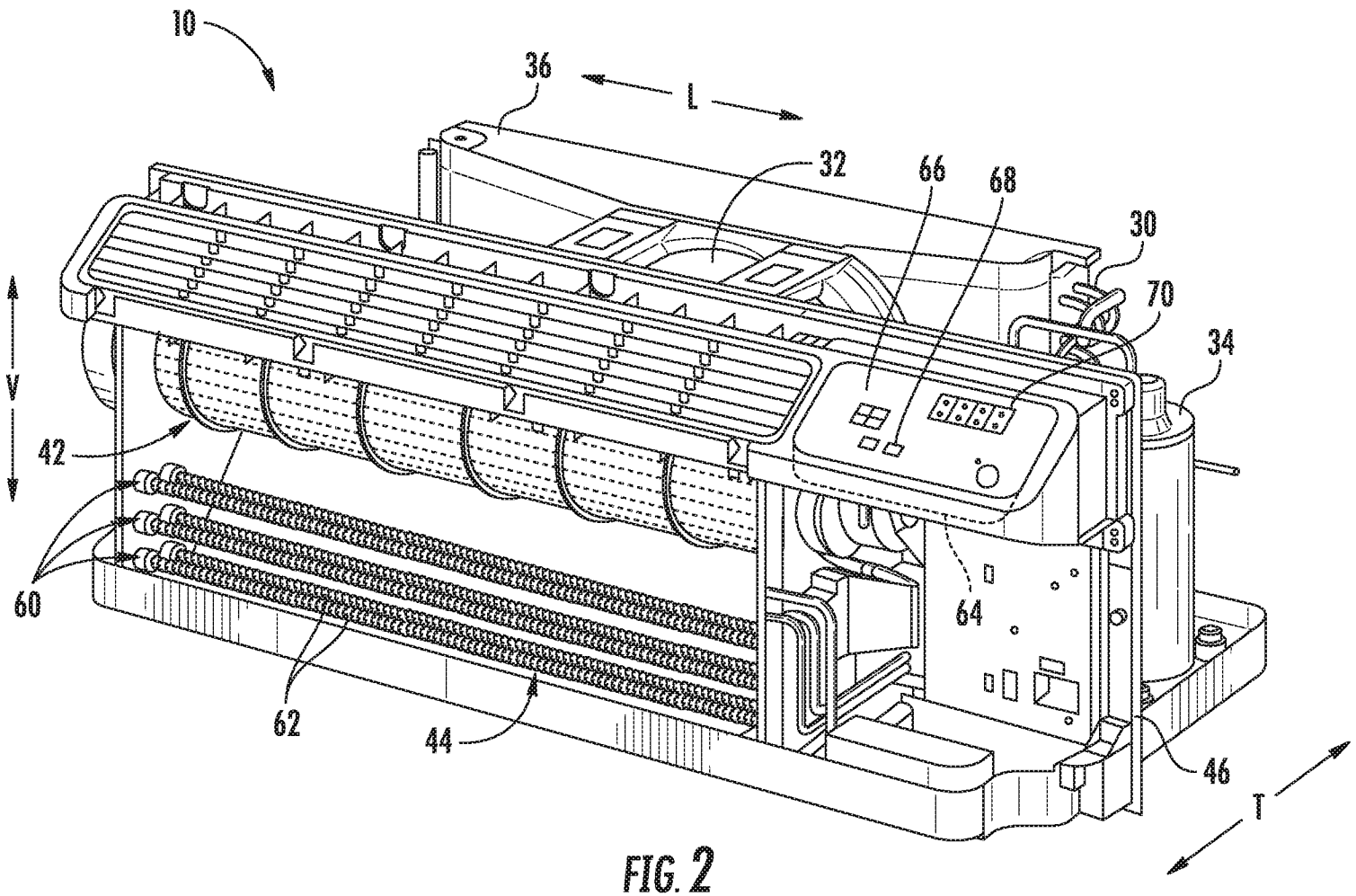
FIG. 2 is another perspective view of components of the indoor portion of the exemplary air conditioner unit of FIG. 1.

Referring now also to FIG. 2, indoor portion 12 may include, for example, an indoor heat exchanger 40 (FIG. 1), a blower fan or indoor fan 42, and a heating unit 44. These components may, for example, be housed behind the room front 24. Additionally, a bulkhead 46 may generally support and/or house various other components or portions thereof of the indoor portion 12, such as indoor fan 42 and the heating unit 44. Bulkhead 46 may generally separate and define the indoor portion 12 and outdoor portion 14.

Figure 3:
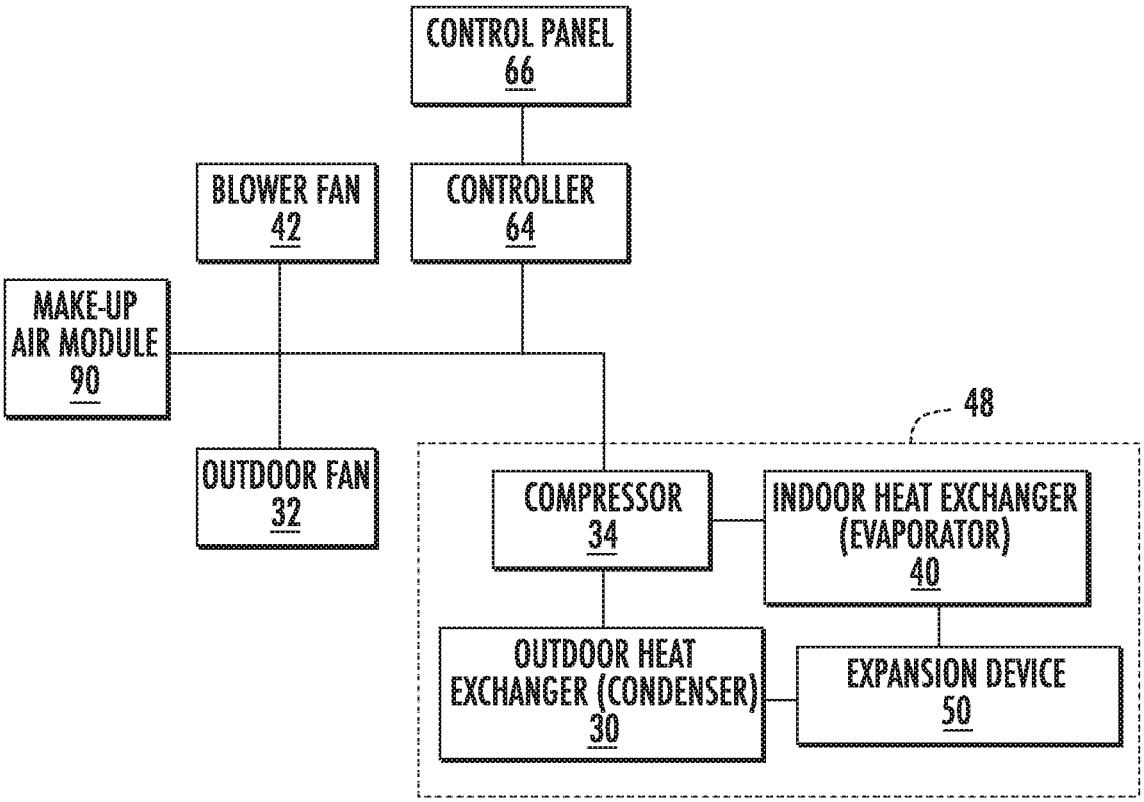
FIG. 3 is a schematic view of a refrigeration loop in accordance with one embodiment of the present disclosure.

Outdoor and indoor heat exchangers 30, 40 may be components of a refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. Suitable refrigerants for use in refrigeration loop 48 may include pentafluoroethane, difluoromethane, or a mixture such as R410a, although it should be understood that the present disclosure is not limited to such example and rather that any suitable refrigerant may be utilized.

As is understood in the art, refrigeration loop 48 may be alternately be operated as a refrigeration assembly (and thus perform a refrigeration cycle) or a heat pump (and thus perform a heat pump cycle). As shown in FIG. 3, when refrigeration loop 48 is operating in a cooling mode and thus performs a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment, compressor 34 may be a variable speed compressor. In this regard, compressor 34 may be operated at various speeds depending on the current air conditioning needs of the room and the demand from refrigeration loop 48. For example, according to an exemplary embodiment, compressor 34 may be configured to operate at any speed between a minimum speed, e.g., 1500 revolutions per minute (RPM), to a maximum rated speed, e.g., 3500 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

In exemplary embodiments as illustrated, expansion device 50 may be disposed in the outdoor portion 14 between the indoor heat exchanger 40 and the outdoor heat exchanger 30. According to the exemplary embodiment, expansion device 50 may be an electronic expansion valve that enables controlled expansion of refrigerant, as is known in the art. More specifically, electronic expansion device 50 may be configured to precisely control the expansion of the refrigerant to maintain, for example, a desired temperature differential of the refrigerant across the indoor heat exchanger 40. In other words, electronic expansion device 50 throttles the flow of refrigerant based on the reaction of the temperature differential across indoor heat exchanger 40 or the amount of superheat temperature differential, thereby ensuring that the refrigerant is in the gaseous state entering compressor 34. According to alternative embodiments, expansion device 50 may be a capillary tube or another suitable expansion device configured for use in a thermodynamic cycle.

According to the illustrated exemplary embodiment, outdoor fan 32 is an axial fan and indoor fan 42 is a centrifugal fan. However, it should be appreciated that according to alternative embodiments, outdoor fan 32 and indoor fan 42 may be any suitable fan type. In addition, according to an exemplary embodiment, outdoor fan 32 and indoor fan 42 are variable speed fans. For example, outdoor fan 32 and indoor fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed, e.g., to reduce noise when full speed operation is not needed. In addition, according to alternative embodiments, fans 32, 42 may be operated to urge make-up air into the room.

According to the illustrated embodiment, indoor fan 42 may operate as an evaporator fan in refrigeration loop 48 to encourage the flow of air through indoor heat exchanger 40. Accordingly, indoor fan 42 may be positioned downstream of indoor heat exchanger 40 along the flow direction of indoor air and downstream of heating unit 44. Alternatively, indoor fan 42 may be positioned upstream of indoor heat exchanger 40 along the flow direction of indoor air, and may operate to push air through indoor heat exchanger 40.

Heating unit 44 in exemplary embodiments includes one or more heater banks 60. Each heater bank 60 may be operated as desired to produce heat. In some embodiments as shown, three heater banks 60 may be utilized. Alternatively, however, any suitable number of heater banks 60 may be utilized. Each heater bank 60 may further include at least one heater coil or coil pass 62, such as in exemplary embodiments two heater coils or coil passes 62. Alternatively, other suitable heating elements may be utilized.

The operation of air conditioner unit 10 including compressor 34 (and thus refrigeration loop 48 generally) indoor fan 42, outdoor fan 32, heating unit 44, expansion device 50, and other components of refrigeration loop 48 may be controlled by a processing device such as a controller 64. Controller 64 may be in communication (via for example a suitable wired or wireless connection) to such components of the air conditioner unit 10. According to exemplary embodiments, controller 64 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 66 and one or more user inputs 68, which may be included in control panel 66. The user inputs 68 may be in communication with the controller 64. A user of the unit 10 may interact with the user inputs 68 to operate the unit 10, and user commands may be transmitted between the user inputs 68 and controller 64 to facilitate operation of the unit 10 based on such user commands. A display 70 may additionally be provided in the control panel 66, and may be in communication with the controller 64. Display 70 may, for example be a touchscreen or other text-readable display screen, or alternatively may simply be a light that can be activated and deactivated as required to provide an indication of, for example, an event or setting for the unit 10.

Figure 4:
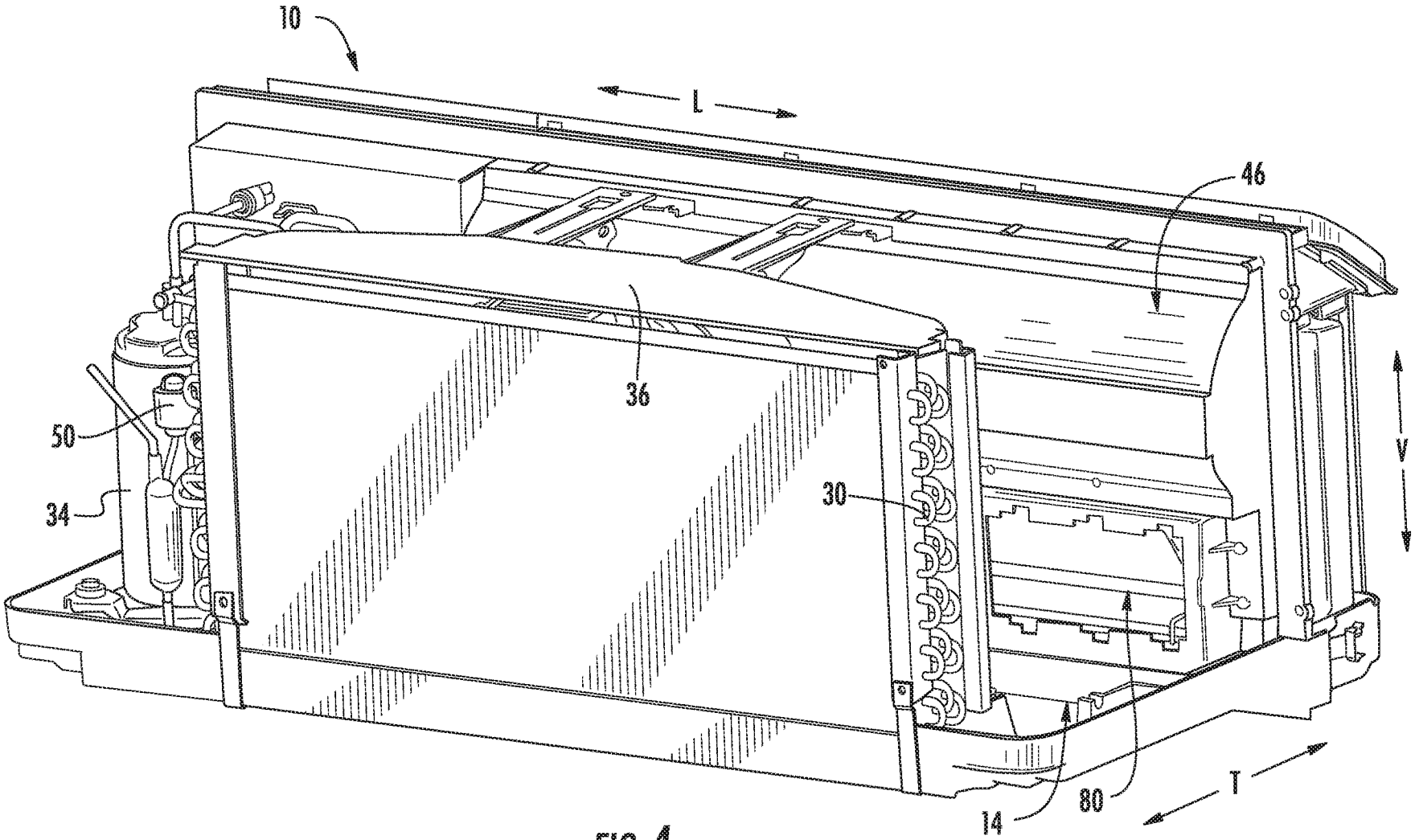
FIG. 4 is a rear perspective view of an outdoor portion of the exemplary air conditioner unit of FIG. 1, illustrating a vent aperture in a bulkhead in accordance with one embodiment of the present disclosure.

Referring briefly to FIG. 4, a vent aperture 80 may be defined in bulkhead 46 providing fluid communication between indoor portion 12 and outdoor portion 14. Vent aperture 80 may be utilized in an installed air conditioner unit 10 to allow outdoor air to flow into the room through the indoor portion 12. In this regard, in some cases it may be desirable to allow outside air (i.e., "make-up air") to flow into the room in order, e.g., to meet government regulations, or to compensate for negative pressure created within the room. In this manner, according to an exemplary embodiment, make-up air may be provided into the room through vent aperture 80 when desired.

Figure 5:
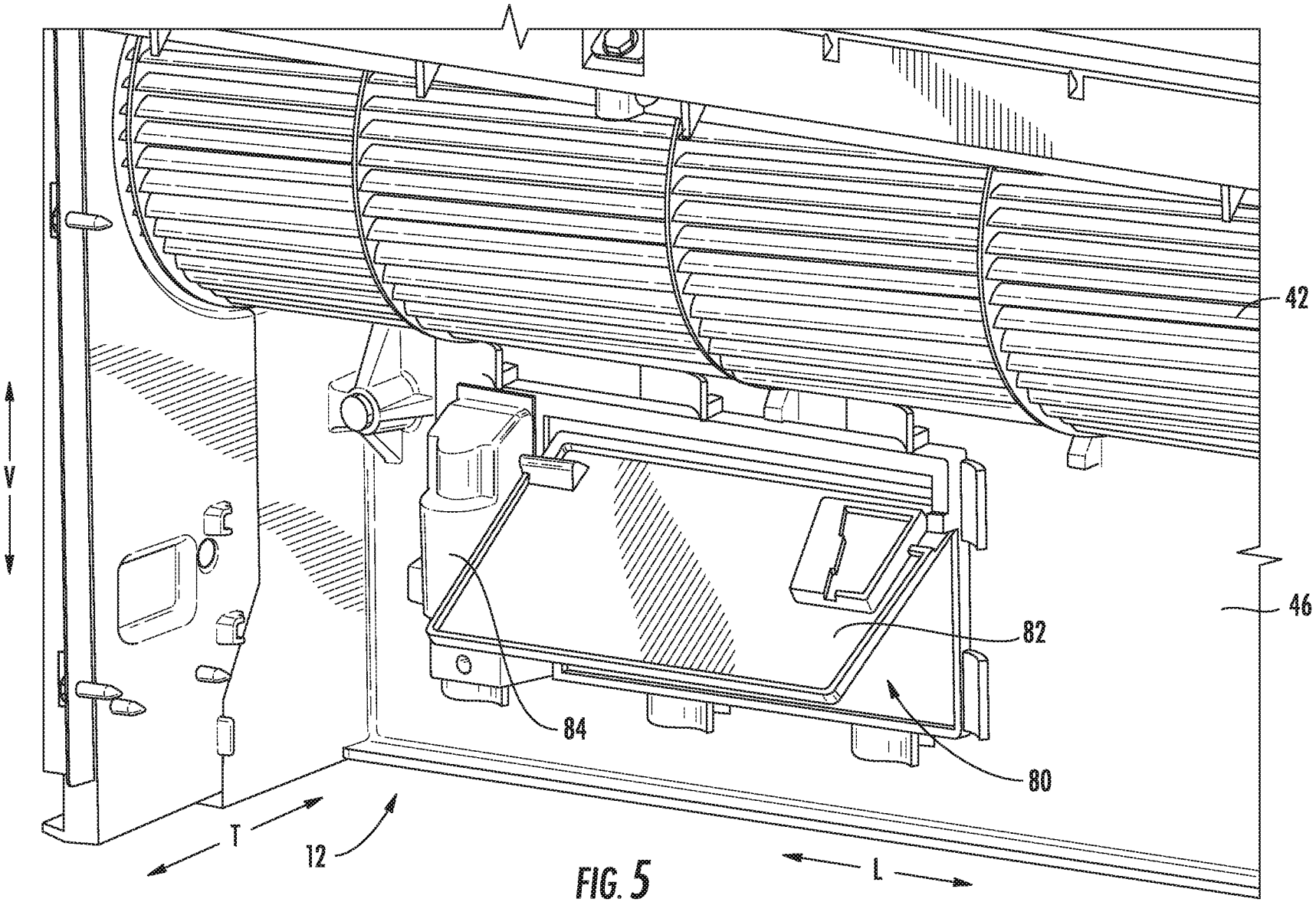
FIG. 5 is a front perspective view of the exemplary bulkhead of FIG. 4 with a vent door illustrated in the open position in accordance with one embodiment of the present disclosure.

As shown in FIG. 5, a vent door 82 may be pivotally mounted to the bulkhead 46 proximate to vent aperture 80 to open and close vent aperture 80. More specifically, as illustrated, vent door 82 is pivotally mounted to the indoor facing surface of indoor portion 12. Vent door 82 may be configured to pivot between a first, closed position where vent door 82 prevents air from flowing between outdoor portion 14 and indoor portion 12, and a second, open position where vent door 82 is in an open position (as shown in FIG. 5) and allows make-up air to flow into the room. According to the illustrated embodiment vent door 82 may be pivoted between the open and closed position by an electric motor 84 controlled by controller 64, or by any other suitable method.

Figure 6:
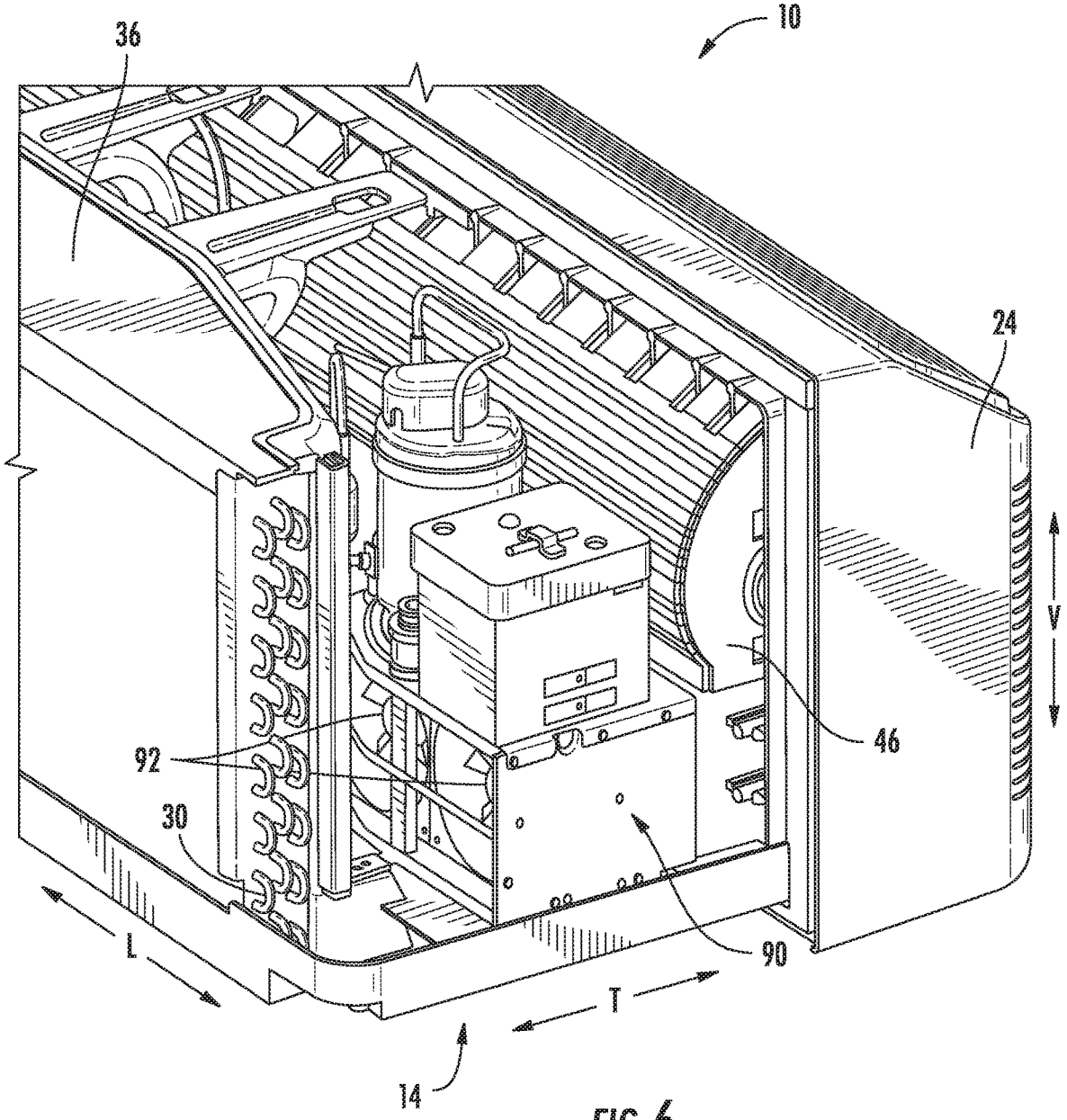
FIG. 6 is a rear perspective view of the exemplary air conditioner unit and bulkhead of FIG. 4 including a make-up air module including a sealed system for conditioning make-up air in accordance with one embodiment of the present disclosure.

In some cases, it may be desirable to treat or condition make-up air flowing through vent aperture 80 prior to blowing it into the room. For example, outdoor air which has a relatively high humidity level may require treating before passing into the room. In addition, if the outdoor air is cool, it may be desirable to heat the air before blowing it into the room. Therefore, as illustrated in FIG. 6, unit 10 may further include an auxiliary sealed system, or make-up air module 90, for conditioning make-up air. As shown, make-up air module 90 and/or an auxiliary fan 92 are positioned within outdoor portion 14 adjacent vent aperture 80 and vent door 82 is positioned within indoor portion 12 over vent aperture 80, though other configurations are possible. According to the illustrated embodiment auxiliary sealed system 90 may be controlled by controller 64, by another dedicated controller, or by any other suitable method.

As illustrated, make-up air module 90 includes auxiliary fan 92 that is configured as part of auxiliary sealed system 90 and may be configured for urging a flow of air through auxiliary sealed system 90. Auxiliary sealed system 90 may further include one or more compressors, heat exchangers, and any other components suitable for operating auxiliary sealed system 90 similar to refrigeration loop 48 described above to condition make-up air. For example, auxiliary system 90 can be operated in a dehumidification mode, an air conditioning mode, a heating mode, a fan only mode where only auxiliary fan 92 is operated to supply outdoor air, an idle mode, etc.

Figure 7:
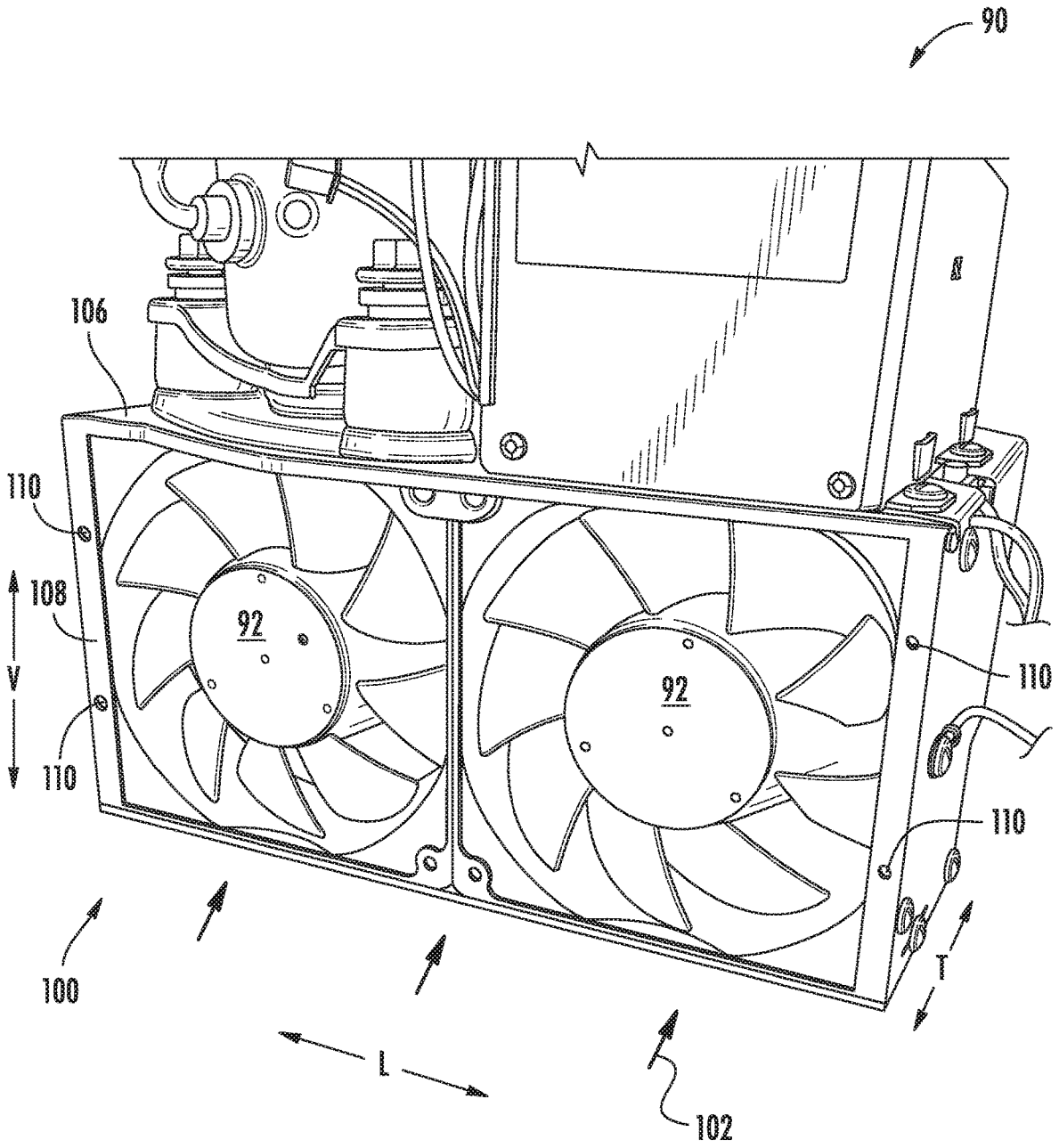
FIG. 7 is a perspective view of a fan assembly of the exemplary make-up air module of FIG. 6 according to an exemplary embodiment of the present subject matter.

Referring now generally to FIG. 7, a filter assembly 100 which may be used to filter a flow of makeup air (e.g., as identified by reference numeral 102 in FIG. 7) will be described according to exemplary embodiments of the present subject matter. Filter assembly 100 is generally designed to facilitate quick and easy installation or replacement of an air filter 104 selected from a plurality of filter sizes. Although filter assembly 100 is described herein as being used with makeup air module 90 of packaged terminal air conditioner unit 10, it should be appreciated that according to alternative embodiments, filter assembly 100 may be used for mounting an air filter on any suitable air moving device, air conditioning system, fan system, etc.

As illustrated, filter assembly 100 may include a receiving structure or mounting features defined on makeup air module 90, auxiliary fan 92, etc. Specifically, as illustrated, the fan housing 106 of auxiliary fan 92 may define a mounting plate 108 that is positioned upstream of auxiliary fan 92. Specifically, as best shown in FIG. 7, mounting plate 108 may be defined by a fan housing 106 and may include a plurality of apertures 110 that are configured for receiving mechanical fasteners 112, such as a bolt, screw, rivet, or any other suitable mechanical fastener.

Referring now specifically to FIGS. 8 through 13, filter assembly 100 may further include a plurality of mounting brackets 120 that are identical to each other and symmetrically positioned on opposite sides of mounting plate 108 and secured by fasteners 112. Once installed, mounting brackets 120 may define a slot 122 for receiving filter 104. Due to the similarity between mounting brackets 120 and associated features, like reference numerals may be used herein to refer to the same or similar features. As explained in more detail below, mounting brackets 120 are designed to be mounted to mounting plate 108 in different orientations to receive different size air filters 104.

According to exemplary embodiments, mounting brackets 120 may be formed from any material which is sufficiently rigid to support air filter 104 during operation of packaged terminal air conditioner unit 10. For example, mounting brackets 120 may be formed by injection molding, e.g., using a suitable plastic material, such as polypropylene, injection molding grade high impact polystyrene (HIPS), acrylonitrile butadiene styrene (ABS), or any other suitable polymeric material. Alternatively, according to the exemplary embodiment, these components may be compression molded, e.g., using sheet molding compound (SMC) thermoset plastic or other thermoplastics. According still other embodiments, mounting brackets 120 may be formed or fabricated from metal or any other suitably rigid material using any suitable manufacturing method, such as stamping metal.

Figure 8:
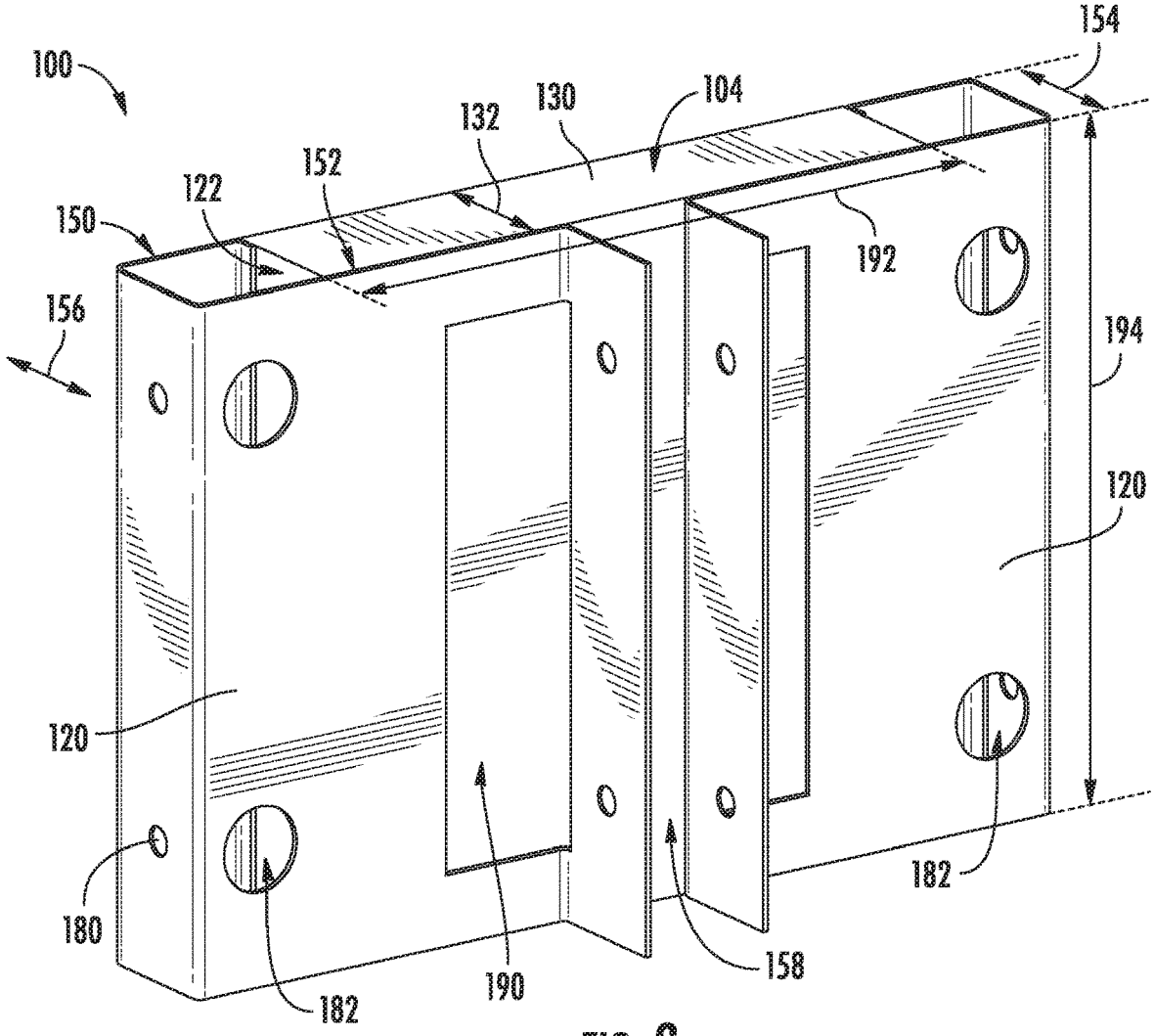
FIG. 8 is a perspective view of a filter assembly that may be used with the exemplary fan assembly of FIG. 6 according to an exemplary embodiment of the present subject matter, with mounting brackets in a first orientation for receiving a first filter.
Figure 9:
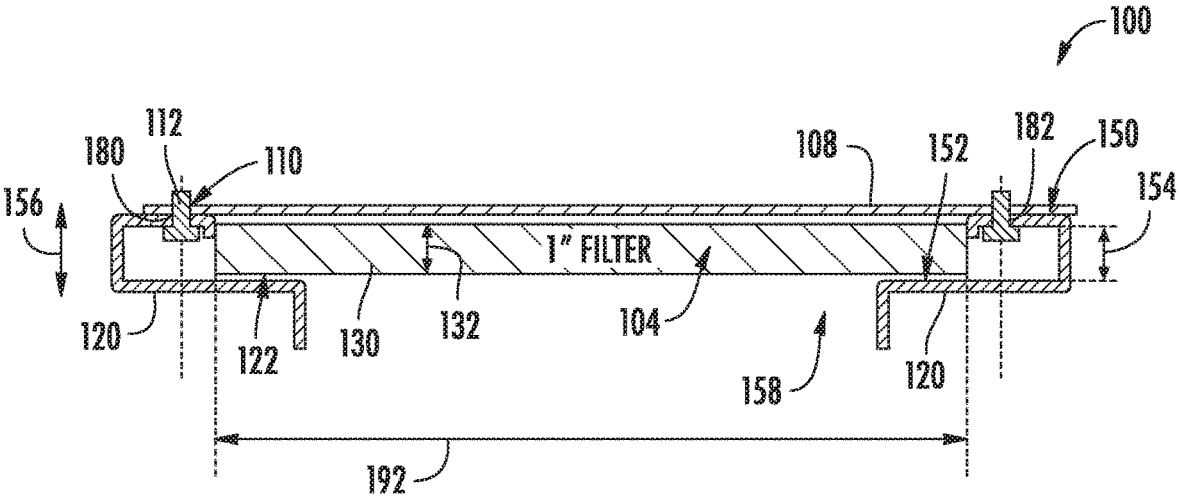
FIG. 9 is a top cross-sectional view of the exemplary filter assembly of FIG. 8.
Figure 10:
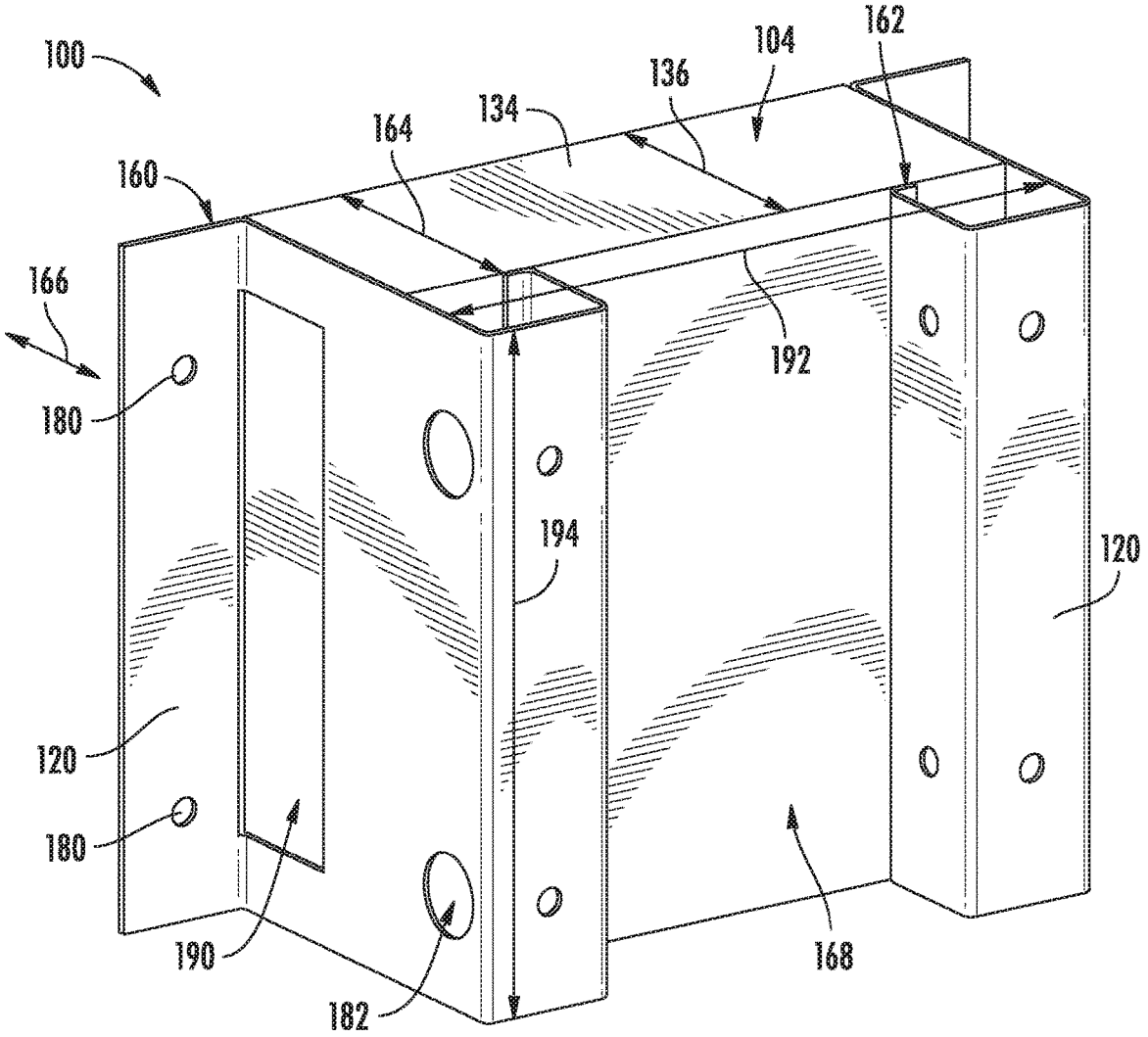
FIG. 10 is a perspective view of a filter assembly that may be used with the exemplary fan assembly of FIG. 6 according to an exemplary embodiment of the present subject matter, with mounting brackets in a second orientation for receiving a second filter.
Figure 11:
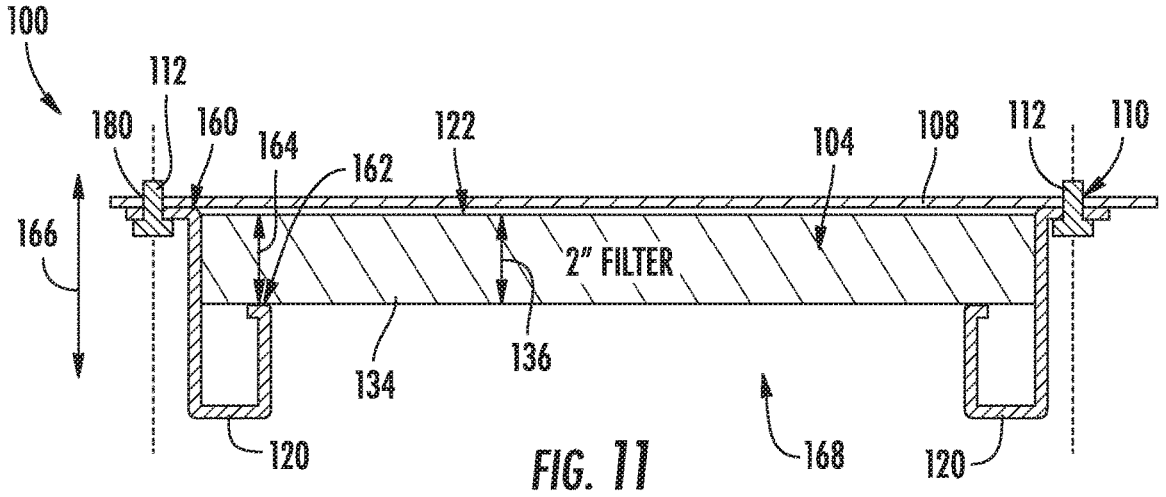
FIG. 11 is a top cross-sectional view of the exemplary filter assembly of FIG. 10.
Figure 12:
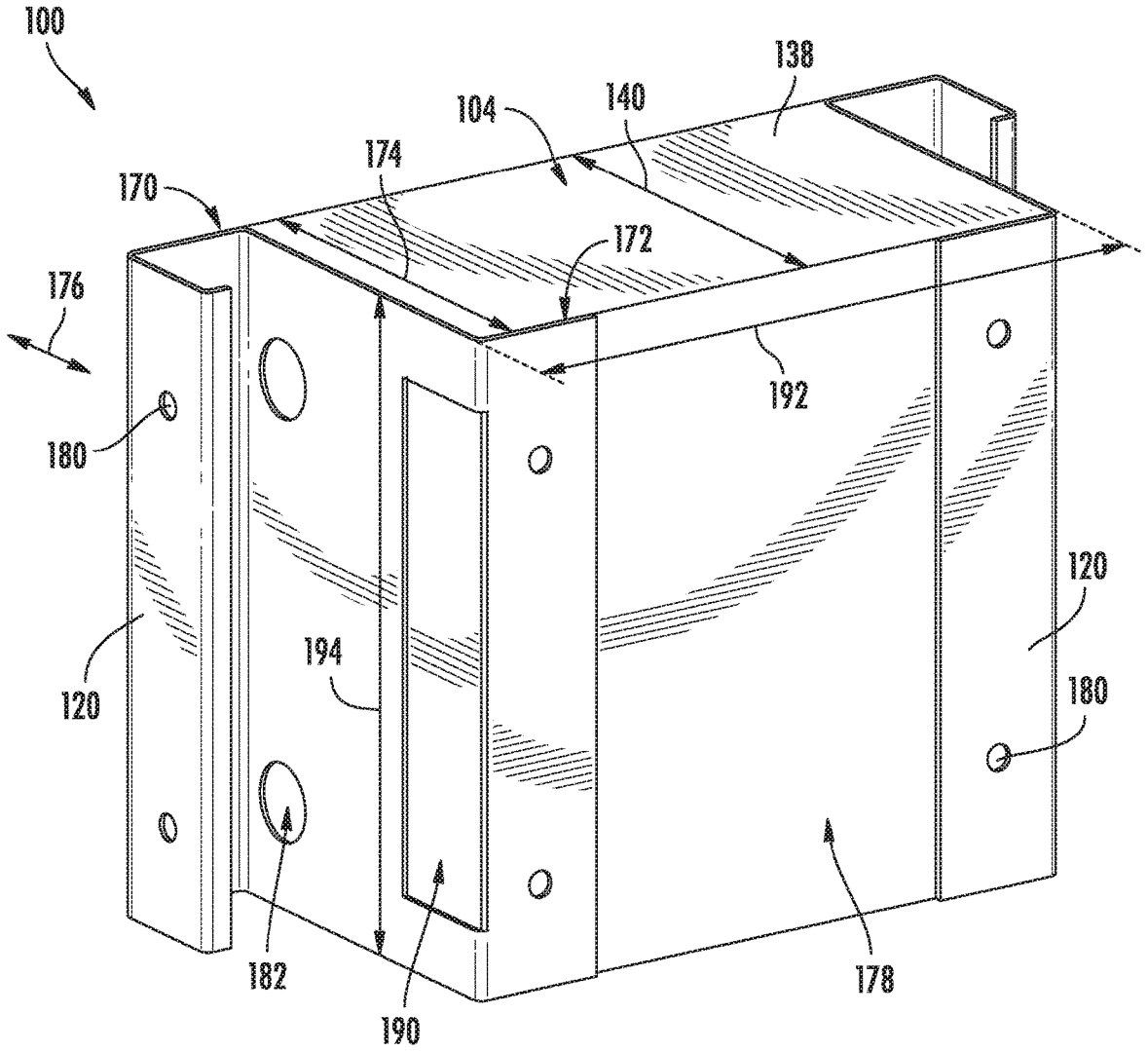
FIG. 12 is a perspective view of a filter assembly that may be used with the exemplary fan assembly of FIG. 6 according to an exemplary embodiment of the present subject matter, with mounting brackets in a third orientation for receiving a third filter.
Figure 13:
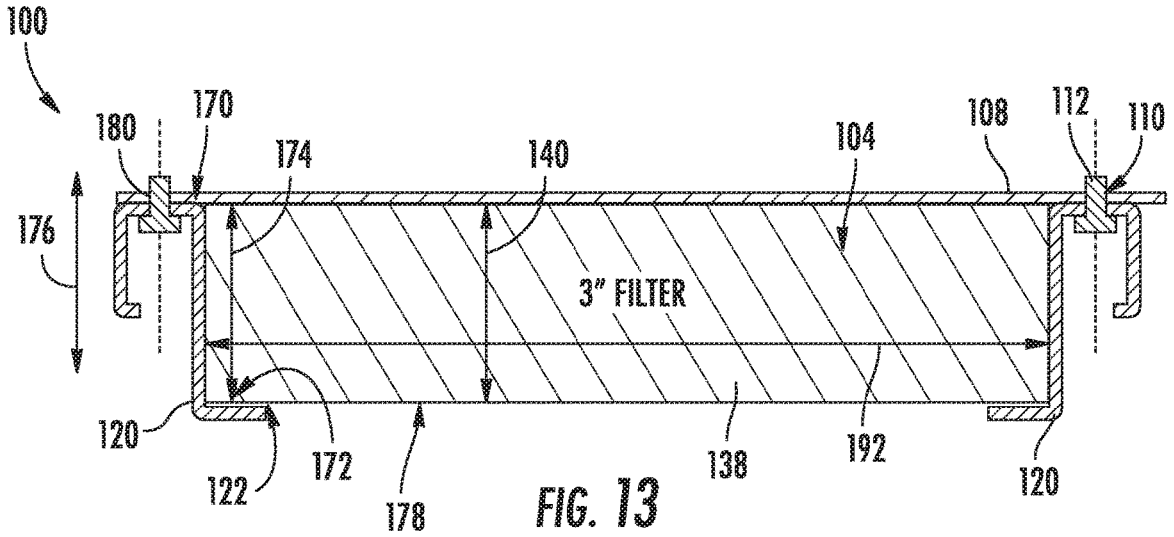
FIG. 13 is a top cross-sectional view of the exemplary filter assembly of FIG. 12.

Referring now generally to FIGS. 8 through 13, mounting brackets 120 will be described according to an exemplary embodiment of the present subject matter. Specifically, FIGS. 8 and 9 illustrate mounting brackets 120 positioned in a first orientation for receiving a first air filter 130 having a first thickness 132. FIGS. 10 and 11 illustrate mounting brackets 120 positioned in a second orientation for receiving a second air filter 134 having a second thickness 136. FIGS. 12 and 13 illustrate mounting brackets 120 positioned in a third orientation for receiving a third air filter 138 having a third thickness 140. According to exemplary embodiments, each of the first thickness 132, the second thickness 136, and the third thickness 140 may be different. It should be appreciated that the size, geometry, and orientations of mounting brackets 120 as well as the size and orientation of air filters 130, 134, 138 described herein are only exemplary and are not intended to limit the scope of the present subject matter in any manner.

As best shown in FIGS. 8 through 13, mounting brackets 120 each define a first mounting surface 150 and in the first retention surface 152 that are spaced apart by a first gap 154 along a first direction 156. Similarly, mounting brackets 120 each define a second mounting surface 160 and a second retention surface 162 spaced apart by a second gap 164 along a second direction 166. In addition, mounting brackets 120 each define a third mounting surface 170 and a third retention surface 172 spaced apart by a third gap 174 along a third direction 176.

The three mounting orientations for mounting brackets 120 may correspond to the position of brackets when mounted by the first mounting surface 150, the second mounting surface 160, and the third mounting surface 170, respectively. In this regard, the first mounting orientation may correspond to the orientation of mounting brackets 120 where first direction 156 corresponds to the transverse direction T, the second mounting orientation corresponds to the orientation of mounting brackets 120 where second direction 166 corresponds to the transverse direction T, and the third mounting orientation corresponds at the orientation of mounting brackets 120 where the third direction 176 corresponds to the transverse direction T.

As shown, the first direction 156 is perpendicular to the second direction 166 and the third direction 176, while the second direction 166 and the third direction are anti-parallel. It should be appreciated that although three mounting orientations and filter thicknesses are described herein, mounting brackets 120 may be configured for receiving any suitable number and size of air filters 104. For example, according to the illustrated embodiment, first gap 154 is approximately 1 inch wide, second gap 164 is approximately 2 inches wide, and third gap 174 is approximately 3 inches wide. In this manner, if mounting brackets 120 are mounted using first mounting surface 150, a 1-inch filter, e.g., first air filter 130 may be used. By contrast, if mounting brackets 120 are mounted using second mounting surface 160, a 2-inch filter, e.g., second air filter 134 may be used. If mounting brackets 120 are mounted using third mounting surface 170, a 3-inch filter, e.g., third air filter 138 may be used.

Referring still to FIGS. 8 through 13, each mounting surface may define a plurality of mounting holes 180 that are configured for receiving mechanical fasteners 112 to secure mounting brackets 120 to mounting plate 108. Specifically, according to exemplary embodiments, the mounting holes 180 may be defined in each mounting surface 150, 160, 170 and may be similarly spaced such that they may be received within apertures 110 defined in mounting plate 108 when mounting brackets 120 are in each of the three orientations. In this regard, mounting holes 180 may be spaced equidistantly and may have a similar size for receiving identical mechanical fasteners 112. In addition, mounting brackets 120 may define one or more access holes 182 to permit a screwdriver to access blind mounting holes 180.

Furthermore, according to the illustrated embodiment, first retention surface 152 of installed mounting brackets 120 may define a first filter opening 158 (e.g., as defined in a cross sectional plane normal to the transverse direction T or the first direction 156). Similarly, second retention surface 162 of installed mounting bracket 120 may define a second filter opening 168. Moreover, third retention surface 172 of installed mounting brackets 120 may define a third filter opening 178. Notably, it may be desirable to ensure that first filter opening 158, second filter opening 168, and third filter opening 178 have identical areas, e.g., to prevent flow restrictions regardless of the filter size used. Thus, mounting brackets 120 may define one or more cutouts 190 that define at least a portion of filter openings 158, 168, and/or 178. Cutouts 190 may be apertures through which air may flow through mounting brackets 120 and may have any suitable size and shape.

In addition, mounting brackets 120 may be designed such that regardless of the orientation of mounting brackets 120, filter slot 122 may have an identical slot height 192 in an identical slot width 194. In this regard, as best shown for example in FIGS. 9, 11, and 13, first air filter 130, second air filter 134, and third air filter 138 may all have an identical width and height, thus only varying in thickness (e.g., having thicknesses of 1 inch, 2 inches, and 3 inches). Having such universal and interchangeable mounting brackets 120 facilitates quick and easy installation of various suitable filters 104 without requiring additional hardware or complex installation procedures.

Now that the construction of air conditioner unit 10 has been described according to exemplary embodiments, an exemplary method 200 of installing an air filter using a filter assembly will be described. Although the discussion below refers to the exemplary method 200 of installing an air filter using mounting brackets 120, one skilled in the art will appreciate that the exemplary method 200 is applicable to the operation of a variety of other filter assemblies and mounting brackets.

Figure 14:
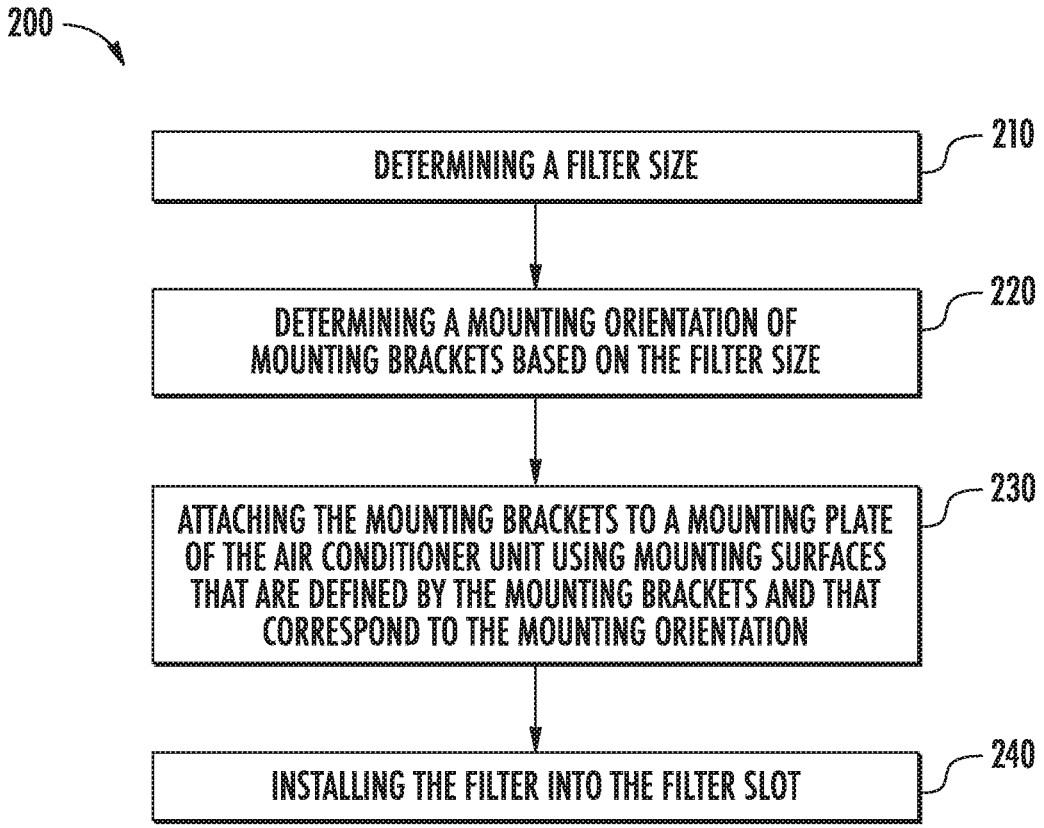
FIG. 14 is a method of installing an air filter using a filter assembly according to an exemplary embodiment of the present subject matter.

Referring now to FIG. 14, method 200 includes, at step 210, determining a filter size, such as a filter thickness, of a filter for use in an air conditioner unit. For example, an operator may select a filter and determine that the filter is a 1-inch filter, a 2-inch filter, or a 3-inch filter compatible with a particular unit. Step 220 includes determining a mounting orientation of mounting brackets based on the filter size. For example, continuing the example from above, if a 1-inch filter such as first air filter 130 is selected, mounting brackets 120 should be mounted using first mounting surface 150, e.g., to position such brackets in the first orientation as shown in FIGS. 8 and 9. By contrast, a 2-inch filter or a 3-inch filter may require mounting on second mounting surfaces 160 or third mounting surface is 170, respectively.

Step 230 includes attaching the mounting brackets to a mounting plate of the air conditioner unit using mounting surfaces that are defined by the mounting brackets and that correspond to the mounting orientation. In this regard, if the first mounting orientation is selected at step 220, the operator may know that first mounting surface 150 should be fixed to mounting plate 108. As explained above, regardless of the mounting surface used, the operator may pass mechanical fasteners 112 through mounting holes 180 in the desired mounting surface 150, 160, 170 for receipt within apertures 110 defined on mounting plate 108. Once mounting brackets 120 are installed, they define filter slot 122 for receiving the air filter 104. Specifically, continuing the example from above, mounting the mounting brackets 120 using first mounting surface 150 defines a first gap 154 between mounting plate 108 and first retention surface 152. Thus, the user may insert the first air filter 130 into filter slot 122 where it may be securely received. Similar procedures may be used for different size filters and mounting brackets.

FIG. 14 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using air conditioner unit 10 and filter assembly 100 as an example, it should be appreciated that these methods may be applied to the to the installation of an air filter using any other filter assembly having any other suitable configuration.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A symmetric pair of mounting brackets for mounting one of a plurality of air filters to an air conditioner unit, each of the mounting brackets comprising:

a first mounting surface and a first retention surface spaced apart by a first gap along a first direction, the first gap being substantially equivalent to a first thickness of a first filter of the plurality of air filters; and a second mounting surface and a second retention surface spaced apart by a second gap along a second direction, the second gap being substantially equivalent to a second thickness of a second filter of the plurality of air filters, wherein the second mounting surface is different than the first mounting surface, the second retention surface is different than the first retention surface, and the second direction is perpendicular to the first direction.

2. The mounting brackets of claim 1, wherein the first gap is approximately 1 inch and the second gap is approximately 2 inches.

3. The mounting brackets of claim 1, wherein the pair of mounting brackets are identical.

4. The mounting brackets of claim 1, wherein the first mounting surface and the second mounting surface each define a plurality of mounting holes for receiving mechanical fasteners to secure the mounting brackets to a mounting plate, wherein the plurality of mounting holes are similarly spaced on the first mounting surface and the second mounting surface for receipt within the same apertures on the mounting plate.

5. The mounting brackets of claim 1, wherein the first retention surface of the mounting brackets defines a first filter opening having a first area and the second retention surface of the mounting brackets defines a second filter opening having a second area, the first area being substantially equivalent to the second area.

6. The mounting brackets of claim 5, wherein the mounting brackets define one or more cutouts that define at least a portion of the first filter opening or the second filter opening.

7. The mounting brackets of claim 1, wherein the mounting brackets define a similar slot height and a similar slot width when either the first mounting surface or the second mounting surface is mounted to a mounting plate.

8. The mounting brackets of claim 1, wherein each of the mounting brackets further comprises:

a third mounting surface and a third retention surface spaced apart by a third gap along a third direction, the third gap being configured for receiving a third filter of the plurality of air filters.

9. The mounting brackets of claim 1, wherein the first direction, the second direction, and the third direction are mutually perpendicular to each other.

10. The mounting brackets of claim 1, wherein the third gap is approximately 3 inches.

11. The mounting brackets of claim 1, wherein the mounting brackets are fabricated from metal.

12. The mounting brackets of claim 1, wherein each of the mounting brackets are constructed as a single, integral, polymeric piece.

13. The mounting brackets of claim 1, wherein the mounting brackets are made from polypropylene.

14. The mounting brackets of claim 1, wherein the mounting brackets are configured for mounting on a mounting plate of a packaged terminal air conditioner unit or a single packaged vertical air conditioner, the mounting plate being positioned over a vent aperture defined in a bulkhead of the packaged terminal air conditioner unit or the single packaged vertical air conditioner.

15. A method of mounting a filter on a mounting plate of an air conditioner unit using symmetric mounting brackets, the method comprising:

determining a filter size;

determining a mounting orientation of the mounting brackets based on the filter size;

attaching the mounting brackets to the mounting plate using mounting surfaces that correspond to the mounting orientation; and installing the filter into a filter slot, wherein the mounting brackets each comprise:

a first mounting surface and a first retention surface spaced apart by a first gap along a first direction, the first gap being substantially equivalent to a first thickness of a first filter of the plurality of air filters; and a second mounting surface and a second retention surface spaced apart by a second gap along a second direction, the second gap being substantially equivalent to a second thickness of a second filter of the plurality of air filters, wherein the second mounting surface is different than the first mounting surface, the second retention surface is different than the first retention surface, and the second direction is perpendicular to the first direction.

16. The method of claim 15, wherein the first mounting surface and the second mounting surface each define a plurality of mounting holes for receiving mechanical fasteners to secure the mounting brackets to the mounting plate, wherein the plurality of mounting holes are similarly spaced on the first mounting surface and the second mounting surface for receipt within the same apertures on the mounting plate.

17. The method of claim 15, wherein the first retention surface of the mounting brackets defines a first filter opening having a first area and the second retention surface of the mounting brackets defines a second filter opening having a second area, the first area being substantially equivalent to the second area.

18. The method of claim 15, wherein each of the mounting brackets further comprises:

a third mounting surface and a third retention surface spaced apart by a third gap along a third direction, the third gap being configured for receiving a third filter of the plurality of air filters, wherein the first direction, the second direction, and the third direction are mutually perpendicular to each other.

* * * * *